US006319302B1

(12) United States Patent
Harada

(10) Patent No.: US 6,319,302 B1
(45) Date of Patent: Nov. 20, 2001

(54) METHOD FOR MANUFACTURING REDUCED IRON AGGLOMERATES AND APPARATUS THERE FOR

(75) Inventor: Takao Harada, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/482,938

(22) Filed: Jan. 14, 2000

(30) Foreign Application Priority Data

Jan. 18, 1999 (JP) ..... 11-009471

(51) Int. Cl.[7] ..... C21B 13/08

(52) U.S. Cl. ..... 75/484; 266/137; 266/160; 266/177

(58) Field of Search ..... 75/484; 266/177, 266/160, 137

(56) References Cited

U.S. PATENT DOCUMENTS

| | | | | |
|---|---|---|---|---|
| 1,119,459 | * | 12/1914 | Von Schlippenbach | 266/177 |
| 3,443,931 | | 5/1969 | Beggs et al. . | |
| 4,597,564 | * | 7/1986 | Hanewald et al. | 266/177 |
| 4,636,127 | | 1/1987 | Olano et al. . | |
| 5,730,775 | | 3/1998 | Meissner et al. . | |
| 6,063,156 | | 5/2000 | Negami et al. . | |
| 6,149,709 | | 11/2000 | Uragami et al. . | |
| 6,241,803 | | 6/2001 | Fuji . | |

FOREIGN PATENT DOCUMENTS

| | | |
|---|---|---|
| 0 828 127 | 3/1997 | (EP) . |
| 10-237519 | 9/1998 | (JP) . |
| 10-317033 | 12/1998 | (JP) . |
| 11-050120 | 2/1999 | (JP) . |
| 11-106814 | 4/1999 | (JP) . |
| WO 98/21538 | 5/1998 | (WO) . |

* cited by examiner

*Primary Examiner*—Melvyn Andrews
(74) *Attorney, Agent, or Firm*—Oblon, Spivak, McClelland, Maier & Neustadt, P.C.

(57) ABSTRACT

A method for manufacturing reduced iron agglomerates comprises the steps of supplying iron oxide agglomerates including carbonaceous material on a moving hearth, heating and reducing the agglomerates to yield reduced iron agglomerates while the moving hearth moves in the reduction furnace, discharging the reduced iron agglomerates from the reduction furnace, recovering the reduced iron agglomerates, and removing seized hearth fragments separated from the moving hearth in close proximity to a discharge location or a recovery location for the reduced iron while the reduction furnace is being operated. According to the method, the reduction furnace can be operated for a long period of time without stopping the operation thereof and supply of the iron oxide agglomerates. Consequently, high productivity of the reduced iron agglomerates can be achieved, and in addition, superior quality in high degree of metallization of the reduced iron agglomerates can be obtained since the seized hearth fragments having low degree of metallization are not mixed with the reduced iron agglomerates as a product.

14 Claims, 6 Drawing Sheets

FIG. 1

| NAME OF SEIZED HEARTH | THICKNESS (mm) | SIZE (SHORTER SIDE mm x LONGER SIDE mm) | SHAPE | CHEMICAL COMPOSITION (WEIGHT%) | | | | |
|---|---|---|---|---|---|---|---|---|
| | | | | TOTAL Fe | FeO | METALLIC Fe | METALLI-ZATION | CARBON |
| A | 35 | 100 x 150 | BLOCK | 71.2 | 66.6 | 0.6 | 0.9 | 0.1 |
| B | 20 | 250 x 300 | CORRUGATED | 88.8 | 33.3 | 59.3 | 66.8 | 0.2 |
| C | 5 | 300 x 2000 | ROLL | 96.8 | 5.5 | 91.4 | 94.3 | 0.1 |

FIG. 2

| | TOTAL Fe | FeO | SiO2 | CaO | PARTICLE SIZE (WEIGHT% OF PARTICLES AT NOT GREATER THAN 75μm) |
|---|---|---|---|---|---|
| IRON ORE | 67.9 | 0.28 | 1.02 | 0.54 | 71% |
| | FIXED CARBON | VOLATILE COMPONENT | ASH COMPONENT | — | PARTICLE SIZE (WEIGHT% OF PARTICLES AT NOT GREATER THAN 75μm) |
| COAL | 72.2 | 18.4 | 9.4 | — | 50 ~ 70% |

FIG. 3

| NO. | NUMBER OF LAYER (*1) | FURNACE TEMPERATURE (°C)*2 | | | METALLIZATION OF PRODUCT (WEIGHT%) | PRODUCTIVITY (kg / m²h) | MEANS FOR REMOVING SEIZED HEARTH | CONTINUOUS OPERATION TIME (HOURS) | REMARKS |
|---|---|---|---|---|---|---|---|---|---|
| | | FRONT ZONE | MIDDLE ZONE | BACK ZONE | | | | | |
| 1 | 0.8 | 1300~1350 | 1340~1380 | 1340~1360 | 87~93 | 100 | YES | >250 | EXAMPLE |
| 2 | 0.8 | 1330~1350 | 1340~1380 | 1340~1360 | 88~93 | 100 | YES | >250 | EXAMPLE |
| 3 | 1 | 1330~1350 | 1340~1380 | 1340~1360 | 85~93 | 100 | NO | 24~32 | COMPARATIVE EXAMPLE |
| 4 | 1 | 1330~1350 | 1340~1360 | 1200~1250 | 88~91 | 55~60 | NO | >250 | COMPARATIVE EXAMPLE |
| 5 | 1.5 | 1330~1350 | 1340~1360 | 1330~1350 | 79~88 | 80~90 | NO | 100~150 | COMPARATIVE EXAMPLE |
| 6 | 2.5 | 1330~1350 | 1330~1350 | 1330~1350 | 70~80 | 100 | NO | >250 | COMPARATIVE EXAMPLE |

*1 : NUMBER OF LAYERS OF DRY PELLETS DISPOSED ON THE HEARTH, CALCULATED FROM AVERAGE DIAMETER, APPARENT DENSITY, AND AMOUNT OF PELLETS FED INTO THE FURNACE.

*2 : RESIDENCE TIME IN EACH ZONE IS APPROXIMATELY ONE-THIRD OF THE TOTAL REDUCING TIME IN THE FURNACE.

METHOD FOR MANUFACTURING REDUCED IRON AGGLOMERATES AND APPARATUS THERE FOR

BACKGROUND OF THE INVENTION

1. Field of the Invention

The present invention relates to a method for manufacturing reduced iron agglomerates by reduction of iron oxide agglomerates incorporating carbonaceous material in a moving hearth reduction furnace, and also relates to an apparatus therefor.

2. Description of the Related Art

Recently, methods for manufacturing reduced iron agglomerates using inexpensive coal as a reducing agent instead of natural gas have again attracted attention. These methods are used to manufacture the reduced iron by heating pellets formed after blending powdered ore with carbonaceous material, such as coal, in a high temperature atmosphere in a reduction furnace.

The methods mentioned above will be described with reference to FIG. 8, which shows a rotary hearth reduction furnace disclosed in U.S. Pat. No. 5,730,775. Iron oxide agglomerates incorporating carbonaceous material are supplied from an inlet 56 and are then spread on the rotary hearth 51 of the reduction furnace so that the thickness of the agglomerate layer is approximately two agglomerates deep. Numeral 57 represents a leveler for leveling the thickness of the agglomerates. Agglomerates in approximately a double layer spread on the hearth move in a direction indicated by an arrow Y concomitant with rotation of the rotary hearth 51. The agglomerates are heated and reduced while being moved, and carbon dioxide and the like, generated when the agglomerates are being reduced, are discharged from a gas exhaust port 42. The reduced iron agglomerates yielded by the heating are discharged from the furnace by a discharging unit 54 after passing the leveler 60. The conventional technology described uses a reducing temperature between about 1,315° C. and 1,430° C., and a reducing time of approximately 10 minutes.

Powder containing iron oxide is also deposited on the surface of the rotary hearth 51, the powder being generated from the iron oxide agglomerates when the agglomerates are supplied into the reduction furnace. When the interior of the reduction furnace contains an atmosphere at high temperature, the iron oxide included in the deposited powder on the rotary hearth 51 is also reduced, and iron metal is therefore generated. When the reduction furnace is operated for a long period of time, the iron metal from the deposited powder which is reduced gradually accumulates so as to form a metal plate having a certain thickness, and the resulting metal plate causes problems in that the metal plate separates from the rotary hearth in the form of rolls or corrugated bodies. When the powder is being deposited, a problem may arise in that the hardened deposited powder having a certain thickness is separated in the form of blocks.

Types of seized hearth fragments are listed in FIG. 1. "Seized hearth A" seized hearth fragment is approximately 35 mm thick, 100 mm in width, and 150 mm in length and is in the form of a block. The "seized hearth A" tends to be generated when the reducing temperature is relatively low, and reduction of the iron oxide in the powder deposited on the hearth insufficiently occurs. Accordingly, the ratio of iron oxide (FeO) is high and degree of metallization is low. The reason for generation of "seized hearth A" is believed to be as follows. Gaps are generated between portions being metallized and portions not being metallized in the deposited powder, containing iron oxide, of a certain thickness, the gaps caused by thermal and mechanical stresses which are applied to the agglomerates during the cycle of supply, reduction with heat, and discharge thereof. Consequently, the hardened deposited powder is separated by a force applied thereto generated by the discharging unit. "Seized hearth C" seized hearth fragment is approximately 5 mm thick, 300 mm in width, and 2,000 mm in length in the form of a roll. The "seized hearth C" tends to be generated when the reducing temperature is relatively high, and reduction of the iron oxide in the powder deposited on the hearth occurs. Accordingly, the ratio of iron oxide (FeO) is low and degree of metallization is high.

FIG. 7 is a schematic view showing a state in which seized hearth fragment is generated in the form of a roll, that is, the so-called "seized hearth C". The powder containing iron oxide deposited on rotary hearth 51 is reduced at an elevated temperature in the reduction furnace, and forms deposited hearth 52. When deposited hearth 52 containing metallic iron increase to a certain thickness, this is separated from rotary hearth 51 by discharging unit 54 which discharges reduced iron agglomerates (pellets) 53 from the reduction furnace and then forms seized hearth fragment 55 in the form of a roll with reduced iron agglomerates rolled up therewith.

"Seized hearth B" seized hearth fragment is approximately 20 mm thick, 250 mm in width, and 300 mm in length in the form of a corrugated plate. "Seized hearth B" tends to be generated when the reducing temperature is medium.

"Seized hearth A" in the form of a block and "seized hearth B" in the form of a corrugated plate are discharged and recovered together with the iron reduced agglomerates from the reduction furnace. In this discharging step, "seized hearth A" and "seized hearth B" obstruct the product-recovery path for recovering the reduced iron agglomerate product, and problem occurs in that the operation of the reduction furnace may sometimes be interrupted. In addition, since seized hearth fragments having low degree of metallization are mixed with the reduced iron agglomerate product, the problem occurs in that the quality of the reduced iron agglomerates may be degraded.

In contrast, "seized hearth C" is so large that it cannot be discharged from the reduction furnace, and gradually grows in the shape of an enormous roll in proximity to discharging unit 54. Once this roll is formed, the reduced iron agglomerates are taken up in the roll and cannot be recovered. In addition, since the roll may damage the reduction furnace, problem may occur in that the operation of the reduction furnace must be terminated to remove "seized hearth C". Once the reduction furnace is stopped, a long period of time is required to restart the furnace, and frequent stopping of operation is therefore a very serious problem. In order to suppress generation of "seized hearth C", it is effective to lower the reducing temperature, as described above; however, metallization of product is reduced, and the quality of reduced iron agglomerates is therefore reduced.

SUMMARY OF THE INVENTION

It is an object of the present invention to provide a method for manufacturing reduced iron agglomerates and an apparatus for manufacturing reduced iron agglomerates. According to the present invention, reduction furnaces can be operated continuously for a long period of time, and reduced iron agglomerates of high quality and having high degree of metallization can be obtained with high productivity.

A method for manufacturing reduced iron agglomerates according to the present invention comprises the steps of supplying iron oxide agglomerates including carbonaceous material on a moving hearth in a reduction furnace, heating the iron oxide agglomerates to yield the reduced iron agglomerates while the moving hearth moves in the reduction furnace, discharging the reduced iron agglomerates from the reduction furnace, and recovering the reduced iron, in which seized hearth fragments separated from the moving hearth are continuously removed in proximity to a discharge location or a recovery location for the reduced iron agglomerates during the operation of the reduction furnace.

In this method, since the seized hearth fragments are continuously removed in proximity to the discharge location or the recovery location for the reduced iron agglomerates, it is not necessary to stop the operation of the reduction furnace and the supply of the iron oxide agglomerates due to generation of the seized hearth fragments. Hence, the reduction furnace can be continuously operated for a long period of time. In addition, since the seized hearth fragments having low degree of metallization are not mixed with the reduced iron agglomerate product, reduced iron agglomerates having high degree of metallization can be obtained.

Seized hearth fragments in the form of blocks or corrugated plates are preferably removed in the midway of a product-recovery path for recovering the reduced iron agglomerates.

Since the seized hearth fragments generated in the form of blocks or corrugated plates, which are readily generated at relatively low reducing temperature, can be removed in the midway of the recovery path for recovering reduced iron agglomerates, the seized hearth fragments do not obstruct the recovery path for the reduced iron agglomerates. Hence, the reduction furnace can be continuously operated for a long period of time. In addition, since the seized hearth fragments are removed from the recovery path during the operation of the reduction furnace, it is not necessary to stop the supply of the iron oxide agglomerates thereto.

At least seized hearth fragments in the form of rolls are preferably removed in front of the discharge location for the reduced iron agglomerates.

Since the seized hearth fragments generated in the form of rolls, which are readily generated at relatively high reducing temperatures, can be removed in front of the discharge location for the reduced iron agglomerates, the seized hearth fragments do not interfere with the recovery of the reduced iron agglomerates, nor do they damage the reduction furnace. Hence, the reduction furnace can be continuously operated for a long period of time.

A thickness of the iron oxide agglomerates layer supplied on the moving hearth is preferably not more than two times the average diameter of the iron oxide agglomerates.

The iron oxide agglomerates thus supplied on the moving hearth can be consistently heated to high temperatures. Hence, variation in degree of metallization of the reduced iron agglomerate product can be minimized, and high degree of metallization and high productivity of the reduced iron agglomerates can therefore be obtained. In contrast, when reduced iron agglomerates are laid thinly, as described above, the hearth and the agglomerates are heated to high temperature, large seized hearth fragments (for example, seized hearth fragments in the form of rolls) are readily generated and metallization on the surface of the hearth occurs. However, even when the seized hearth fragments in the form of rolls are generated, the reduction furnace can be operated for a long period of time by removing the seized hearth fragments from the furnace.

The reducing temperature is preferably maintained at not less than 1,300° C. when iron oxide agglomerates are heated and reduced.

In the condition mentioned above, the reducing time can be shortened, productivity can be improved, and high degree of metallization of the reduced iron agglomerates can be achieved. When the reducing temperature is raised, large seized hearth fragments are readily generated; however, according to the present invention, the reduction furnace can be continuously operated for a long period of time since the seized hearth fragments can be removed.

A roller screen is preferably provided in the midway of the recovery path for recovering reduced iron agglomerates in order to remove seized hearth fragments in at least one form of blocks and corrugated plates.

In the recovery path, which is sometimes obstructed by the seized hearth fragments, the roller screen can remove the seized hearth fragments. Since the roller screen can ensure removal of various shapes of seized hearth fragments by rolling, the seized hearth fragments in the form of blocks or corrugated plates do not interfere with the operation of the manufacturing apparatus. In addition, the degree of metallization of the reduced iron agglomerates are not degraded since the seized hearth fragments are not mixed with the reduced iron agglomerates.

Furthermore, a seized hearth fragment removing screw is preferably disposed in front of the discharging unit for removing at least the seized hearth fragments in the form of rolls.

The seized hearth fragments can be reliably removed by the seized hearth fragment removing screw mentioned above in front of the product discharging unit where the seized hearth fragments are generated in the form of rolls. Since this screw can take up the seized hearth fragments in the form of rolls, the operation of the apparatus for manufacturing the reduced iron agglomerates can be performed without any problems.

BRIEF DESCRIPTION OF THE DRAWINGS

FIG. 1 is a table listing various types of seized hearths fragment;

FIG. 2 is a table listing chemical compositions and characteristics of agglomerates of the Examples according to the present invention;

FIG. 3 is a table listing experimental conditions and results of the Examples according to the present invention and of Comparative Examples;

DESCRIPTION OF THE PREFERRED EMBODIMENTS

The embodiments according to the present invention will be described with reference to the accompanying drawings.

Figure 4:
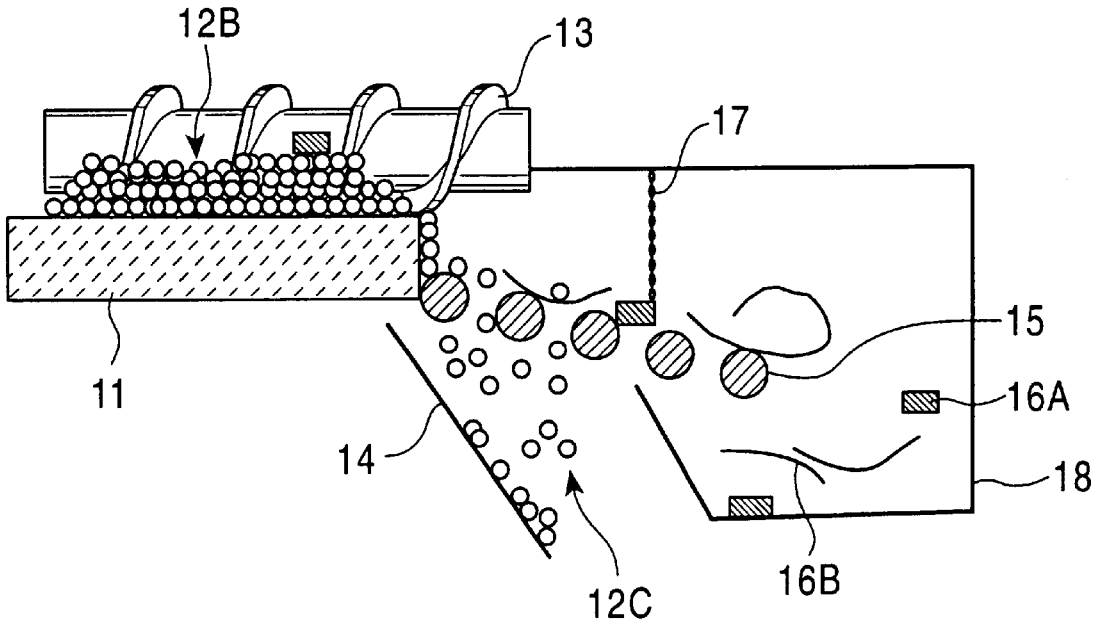
FIG. 4 is a schematic cross-sectional view of a manufacturing apparatus for reduced iron for carrying out a first Embodiment according to the present invention.

FIG. 4 is a schematic cross-sectional view of an apparatus for manufacturing reduced iron for carrying out a first Embodiment according to the present invention.

Numeral 11 in FIG. 4 indicates a circular moving hearth, on the upper surface of which iron oxide agglomerates incorporating carbonaceous material in the form of pellets are supplied. These iron oxide agglomerates placed on moving hearth 11 are heated and reduced to yield reduced iron agglomerates in the form of pellets. The reduced iron agglomerates are separated from moving hearth 11 by product discharging screw 13 as a product discharging unit, protrude in front of product discharging screw 13 as indicated by numeral 12B in FIG. 4, and are then transported from moving hearth 11 along with rotation of product discharging screw 13. As indicated by numeral 12C in FIG. 4, the reduced iron agglomerates transported by product discharging screw 13 are recovered through discharging chute 14 (path for recovering product) which is disposed at the side of product discharging screw 13. In the midway of discharging chute 14, roller screen 15 (means for removing seized hearth fragments) is disposed so as to slope down to the right. Box 18 for recovering seized hearth fragments is disposed at the end portion of roller screen 15 and chain 17 is suspended above roller screen 15.

A seized hearth fragment 16A in the form of a block and a seized hearth fragment 16B in the form of a corrugated plate, generated during the operation of the reduction furnace, are discharged to discharging chute 14 together with the reduced iron agglomerates; however, seized hearths fragments, which cannot pass through gaps in roller screen 15, are transported along the slope of roller screen 15 and are recovered in box 18 for recovering seized hearths fragments.

As described above, seized hearth fragment 16A in the form of a block and seized hearth fragment 16B in the form of a corrugated plate are sieved from discharging chute 14 of the path for recovering product, and are continuously recovered in box 18 for recovering seized hearth fragments during the operation of the reduction furnace, so that discharging chute 14 is not obstructed by seized hearth fragments even when they are generated. Accordingly, the reduction furnace can be operated for a long period of time regardless of generation of seized hearth fragments 16A and 16B. In addition, since seized hearth fragments 16A and 16B having low degrees of metallization are not mixed with the reduced iron agglomerates, in other words, are separated from the reduced iron agglomerates, the quality such as high metallization of the reduced iron agglomerates as commercial product can be improved.

Forms of seized hearth fragments recovered by roller screen 15 are not limited to "corrugated" and "block", and other forms of seized hearth fragments can also be removed. The terms "corrugated" and "block" are used simply to illustrate typical forms of seized hearth fragments.

Figure 5:
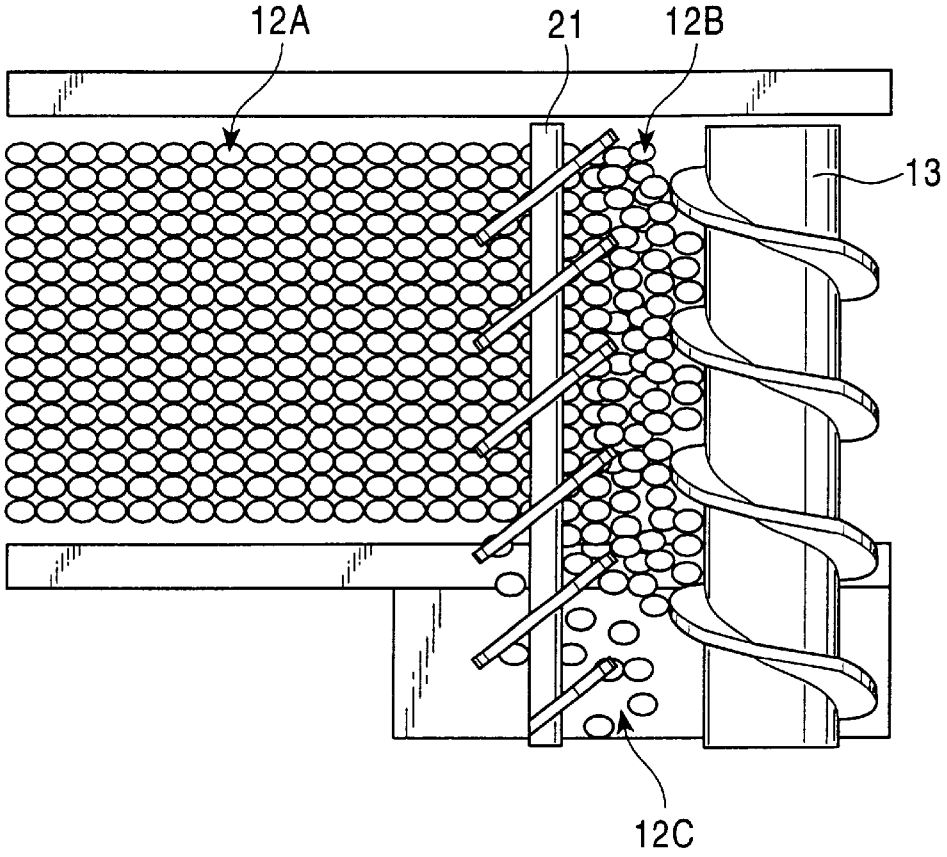
FIG. 5 is a plan view of a manufacturing apparatus for reduced iron for carrying out a second Embodiment according to the present invention.

Next, another embodiment of an apparatus for manufacturing reduced iron will be described with reference to FIGS. 5 and 6. FIG. 5 is a schematic plan view of a second Embodiment of an apparatus for manufacturing reduced iron according to the present invention, and FIG. 6 is a side view thereof.

Figure 6:
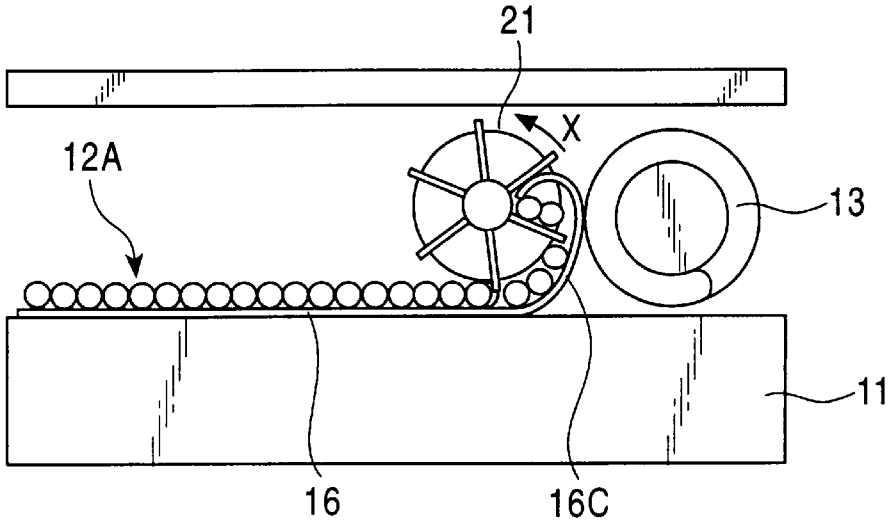
FIG. 6 is a side view of a manufacturing apparatus for reduced iron for carrying out the second Embodiment according to the present invention.
Figure 7:
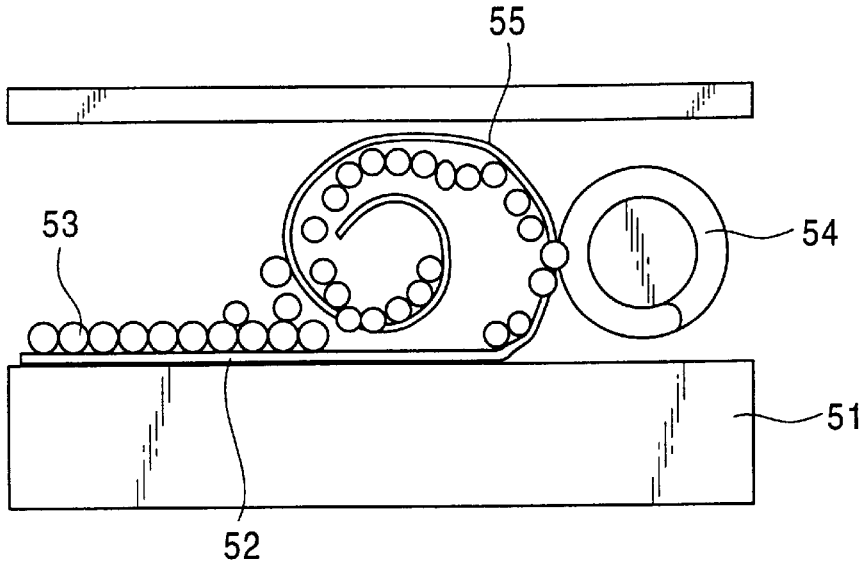
FIG. 7 is a schematic side view showing generation of seized hearth fragment in the form of a roll when a method for manufacturing reduced iron according to the present invention is being carried out.
Figure 8:
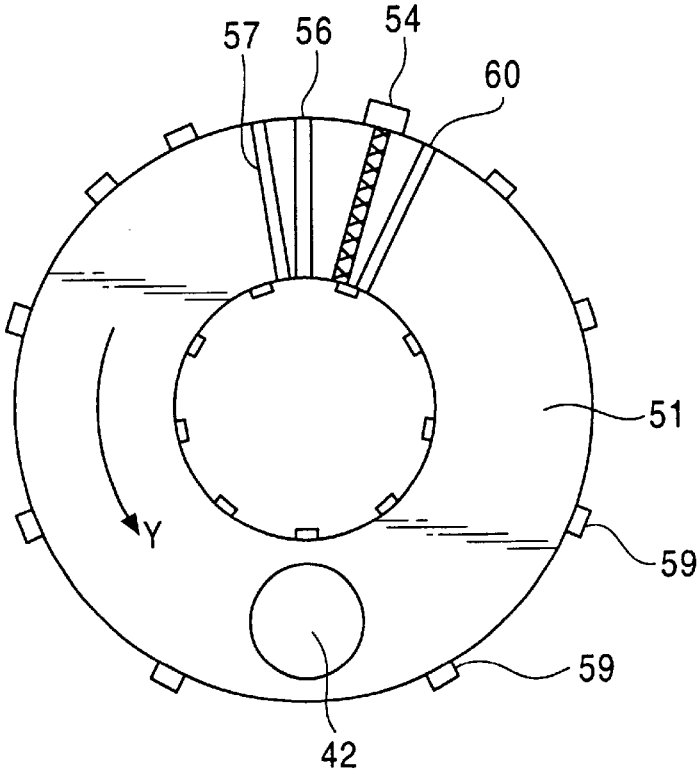
FIG. 8 RELATED ART
FIG. 8 is a plan view of a rotary hearth reduction furnace as an example of conventional technology.

In FIGS. 5 and 6, reduced iron agglomerates 12A supplied on moving hearth 11 not more than two layers deep are discharged from the reduction furnace by product discharging screw 13 and are recovered as a product. In front of product discharging screw 13, seized hearth discharging screw 21 as a means for discharging seized hearth fragments is disposed and rotates in a direction indicated by arrow X in FIG. 6.

Powder containing iron oxide deposited on the surface of moving hearth 11 is reduced, and a hearth having metallic iron is thereby formed. When the reducing temperature is high, such as when it exceeds 1,300° C., metallic iron particles on the hearth bond together and thereby form flat hearth 16. Flat hearth 16 is separated in front of product discharging screw 13 when flat hearth 16 grows to a certain thickness. Once flat hearth 16 in the form of a plate is separated, since flat hearth 16 is successively transported by movement of moving hearth 11, it is continuously separated and is taken up by rotation of product discharging screw 13. Consequently, flat hearth 16 is sometimes formed into a roll, such as seized hearth fragment 16C (for example, the form of "seized hearth C" in Table 1). The seized hearth fragment 16C is taken up by seized hearth discharging screw 21. The seized hearth fragment 16C in the form of roll taken up by discharging screw 21 is removed from the reduction furnace by a scraping unit (not shown) to the reduction furnace side during the operation of the reduction furnace. Since seized hearth fragment 16C is thin and soft, it is easily cut into smaller fragments or pressed by applying mechanical shearing force. Hence, it is not very difficult to remove seized hearth fragment 16C taken up from the reduction furnace.

As described above, seized hearth fragment 16C is taken up by discharging screw 21 and is continuously recovered during the operation of the reduction furnace, so that operation of the reduction furnace is not disturbed by seized hearth fragment 16C even when it is generated. Hence, the reduction furnace can be operated for a long period of time without the operation being stopped. This discharging screw 21 is particularly effective in operation at high temperatures at which seized hearth fragment 16C is readily generated.

The form of seized hearth fragment recovered by discharging screw 21 is not limited to a "roll" and other forms of seized hearth fragments can also be removed. The term "roll" is used simply to illustrate a typical form of seized hearth fragments.

In the embodiment described above, seized hearth discharging screw 21 as an example of the "means for removing seized hearth fragments" is disposed just in front of product discharging screw 13 for discharging the reduced iron agglomerates from the reduction furnace and roller screen 15 as another example of the "means for removing seized hearth fragments" is disposed in the midway of discharging chute 14 for recovering the reduced iron agglomerates from the reduction furnace; however, the position of the "means for removing seized hearth fragments" is not limited to those described above. For example, the "means for removing seized hearth fragments" may be disposed at the back of product discharging screw 13. It is important that the "means for removing seized hearth fragments" be disposed in proximity to the discharge location or the recovery location for the reduced iron agglomerates.

In the embodiments described above, discharging screw 21 or roller screen 15 is separately employed as the "means for removing seized hearth fragments"; however, it is more preferable to use both of them. In this case, the capacity to remove seized hearth fragments is further enhanced.

Particular forms of the "means for removing seized hearth fragments" are not limited to the screw and the screen described above, and forms such as pitchforks, pistons, hook-shaped removers, and the like may be employed.

In the embodiments described above, product discharging screw 13 is employed as a "product discharging unit"; however, this is not so limited. For example, a discharging unit in the form of a sluice or a pusher may be employed.

In the embodiments described above, discharging chute 14 is employed as a "product-recovery path"; however, this is not so limited. For example, reduced iron may be recovered using a belt conveyor and the like.

In the embodiments described above, a reduction furnace having a rotary moving hearth is employed; however, this is not so limited. For example, a reduced furnace having a straight moving hearth rotated in the manner of a belt conveyor may be employed.

In the embodiments described above, the form of the pellet is described as being an "agglomerate"; however, any lump of reduced iron or iron oxide may be employed instead of the pelleted "agglomerate".

Next, Examples of methods for manufacturing reduced iron agglomerates will be explained with reference to FIGS. 2 and 3.

In the Examples, a mixture of an iron ore and coal in a ratio of 79:21 by dry weight, chemical compositions and characteristics thereof being listed in FIG. 2, was used as a primary ingredient. Binder (flour) and water were added to this primary ingredient, and this was then granulated using a disk type pelletizer to form pellets having diameters of 14 to 20 mm. Pellets containing not more than 1% of water by dehydration were continuously supplied to a rotary moving hearth reduction furnace and were then reduced. Experimental conditions for this reduction and results thereof are listed in FIG. 3. Samples Nos. 1 and 2 were according to the Examples of the present invention employing the "means for removing seized hearth fragments", and sample Nos. 3 to 6 were according to Comparative Examples, which did not employ the "means for removing seized hearth fragments".

In samples Nos. 1 and 2, the number of layers of iron oxide pellets was 0.8, which was thin, and reducing temperatures in a front zone, a middle zone, and a back zone all exceeded 1,300° C. Accordingly, high degree of metallization of not less than 87% and high productivity of 100 $kg/m^2$.hour could be obtained. Continuous operation exceeded 250 hours due to the provision of the "means for removing seized hearth fragments", and continuous operation for a long period of time was possible. The number of layers of iron oxide agglomerates is an indication of the approximate mean thickness of supplied iron oxide agglomerate layer compared to the average diameter of the iron oxide pellets.

Residence times in the "front zone", "middle zone", and "back zone" are each approximately one-third of the total reducing time.

In contrast, since the "means for removing seized hearths fragments" was not provided for sample No. 3, seized hearth fragments in the form of rolls were generated and continuous operation was possible for only 24 to 32 hours. Considering that 2 days are required to restart a reduction furnace which has been completely stopped, a reduction furnace which must be stopped after approximately 24 hours of operation is not practical.

For sample No. 4, continuous operation could be performed for not less than 250 hours with some difficulty; however, since the temperature of the back zone of the furnace was set to be not more than 1,250° C., productivity of only 55 to 60 $kg/m^2$.hour was obtained, which was seriously inferior to that of samples Nos. 1 and 2. One reason for this was that the rotation speed of the moving hearth was decreased in order to obtain a sufficiently high degree of metallization to compensate for the lower reducing temperature. The other reason was that operation for removing seized hearth fragments which had low degree of metallization and which obstructed the discharging chute, was performed by stopping the supply of iron oxide agglomerates intermittently during the operation of the reduction furnace. Continuous operation for this sample exceeded 250 hours, which was determined to be the upper limit of continuous operation in the experiments; however, when the operation was continued without performing any adjustment of the conditions, it is believed that continuous operation was shorter than those of sample Nos. 1 and 2. In addition, when the operation for removing seized hearth fragments by intermittently stopping the supply of iron oxide pellets was not performed, it is believed that the operation of the reduction furnace had to be stopped since the discharging chute was obstructed by the seized hearth fragments.

Samples Nos. 5 and 6 are examples obtained when the number of layers of the iron oxide pellets were 1.5 and 2.5, respectively, without having the "means for removing seized hearth fragments". In sample No. 5, seized hearth fragments in the form of rolls were generated since the "means for removing seized hearth fragments" was not provided, and continuous operation could be performed for only 100 to 150 hours. The reason the continuous operation was longer than that for sample No. 3 is believed to be that the temperature to which the powder deposited on the moving hearth was raised was relatively low due to the thicker layers of the iron oxide. When sample No. 5 was provided with the "means for removing seized hearth fragments", it is believed that the continuous operation could exceed 250 hours. In contrast, it was difficult for the continuous operation for sample No. 6 to exceed 250 hours; however, degree of metallization was only up to 80% and product quality was seriously inferior. The reason for this was that iron oxide pellets at the bottom were not fully reduced due to thickness of 2.5 layers. The reason the continuous operation could last 250 hours with difficulty is believed to be that powder deposited on the moving hearth was not reduced due to thicker layers, and relatively small amounts of seized hearth fragments were generated.

As can be seen from sample No. 3 in FIG. 3, when the iron oxide pellets are supplied on the moving hearth, thickness of the iron oxide pellet layer is preferably not more than twice the average diameter of the pellets. When the thickness exceeds twice the average diameter of the iron oxide pellets, the degree of metallization decreases and the value of the reduced iron pellets as a product is seriously degraded.

As can be seen from sample No. 4 in FIG. 3, the reducing temperature is preferably not less than 1,300° C. when iron oxide pellets are heated and reduced. When the reducing temperature is less than 1,300° C., productivity of reduced iron pellets must be lowered in order to maintain the degree of metallization in the product.

A green material mixture in this embodiment comprises iron oxide, as ingredient, and contains a carbonaceous material in an amount sufficient to reduce the iron oxide and optionally a binder such as an organic binder in an amount sufficient to bind the iron oxide and the carbonaceous material.

The iron oxide as the ingredient of the green material mixture includes powdery iron ore or mill scale. Blast furnace dust, converter dust, dust from sintering process and electric furnace dust and mixtures thereof can also be used. Since the dusts mentioned above contain a carbon ingredient, addition of carbonaceous material is not required or addition amount can be decreased.

What is claimed is:

1. A method for manufacturing reduced iron agglomerates, the method comprising the steps of:

supplying iron oxide agglomerates including carbonaceous material on a moving hearth in a reduction furnace;

heating the iron oxide agglomerates to yield the reduced iron agglomerates and hearth fragments which are occasionally seized during operations on the moving hearth while the moving hearth moves in the reduction furnace;

discharging the reduced iron agglomerates from the reduction furnace; and removing the seized hearth fragments from the moving hearth during the operation of the reduction furnace, wherein at least a portion of the seized hearth fragments are in a form selected from the group consisting of blocks and corrugated plates; and the seized hearth fragments in a form selected from the group consisting of blocks and corrugated plates are removed from the moving hearth in proximity to any one of a discharge location for the reduced iron agglomerates and a discharging chute for the reduced iron agglomerates.

2. A method for manufacturing reduced iron agglomerates, the method comprising the steps of:

supplying iron oxide agglomerates including carbonaceous material on a moving hearth in a reduction furnace;

heating the iron oxide agglomerates to yield the reduced iron agglomerates and hearth fragments which are occasionally seized during operations on the moving hearth while the moving hearth moves in the reduction furnace;

discharging the reduced iron agglomerates from the reduction furnace; and removing the seized hearth fragments from the moving hearth during the operation of the reduction furnace, wherein at least a portion of the seized hearth fragments are in the form of rolls; and the seized hearth fragments in the form of rolls are removed from the moving hearth in front of the discharge location for the reduced iron agglomerates.

3. The method according to claim 1, further comprising recovering the reduced iron agglomerates.

4. The method according to claim 2, further comprising recovering the reduced iron agglomerates.

5. The method according to claim 1, wherein the thickness of the iron oxide agglomerates supplied on the moving hearth is not more than two times the average diameter of the iron oxide agglomerates.

6. The method according to claim 2, wherein the thickness of the iron oxide agglomerates supplied on the moving hearth is not more than two times the average diameter of the iron oxide agglomerates.

7. The method according to claim 1, wherein the reducing temperature is maintained at not less than 1,300° C. while the iron oxide agglomerates are heated and reduced.

8. The method according to claim 2, wherein the reducing temperature is maintained at not less than 1,300° C. while the iron oxide agglomerates are heated and reduced.

9. An apparatus for manufacturing reduced iron agglomerates, the apparatus comprising:

a reduction furnace provided with a moving hearth;

supplying means for supplying iron oxide agglomerates including carbonaceous material on the moving hearth;

heating means for heating iron oxide agglomerates to yield the reduced iron agglomerates and seized hearth fragments on the moving hearth while the moving hearth moves in the reduction furnace;

discharging means for discharging the reduced iron agglomerates from the reduction furnace; and removing means for removing the seized hearth fragments from the reduction furnace during the operation of the reduction furnace, wherein the removing means comprises recovering means for recovering the reduced iron agglomerates and the seized hearth fragments after the reduced iron agglomerates and the seized hearth fragments are removed from the reduction furnace; and the recovering means comprises a sieve.

10. The apparatus according to claim 9, wherein the sieve comprises a roller screen.

11. An apparatus, for manufacturing reduced iron agglomerates by a process comprising the steps of supplying iron oxide agglomerates including carbonaceous material on a moving hearth, heating the iron oxide agglomerates to yield the reduced iron agglomerates and seized hearth fragments on the moving hearth while the moving hearth moves in the reduction furnace, discharging the reduced iron agglomerates from the reduction furnace, and recovering the reduced iron agglomerates, the apparatus comprising removing means for continuously removing the seized hearth fragments from the reduction furnace during the operation of the reduction furnace, wherein the removing means is disposed in proximity to any one of a discharge location and a recovery location for the reduced iron agglomerates from the reduction furnace;

the removing means comprises recovering means for recovering the reduced iron agglomerates and the seized hearth fragments after the reduced iron agglomerates and the seized hearth fragments are removed from the reduction furnace; and the recovering means comprises a sieve.

12. A method for manufacturing reduced iron agglomerates by a process comprising the steps of supplying iron oxide agglomerates including carbonaceous material on a moving hearth, heating the iron oxide agglomerates to yield the reduced iron agglomerates and hearth fragments which are occasionally seized during operations on the moving hearth while the moving hearth moves in the reduction furnace, discharging the reduced iron agglomerates from the reduction furnace, and recovering the reduced iron agglomerates, wherein the seized hearth fragments are separated from the moving hearth and continuously removed in proximity to any one of a discharge location and a recovery location for the reduced iron agglomerates during the operation of the reduction furnace.

13. An apparatus for manufacturing reduced iron agglomerates, the apparatus comprising a reduction furnace including a moving hearth on which the reduced iron agglomerates and seized hearth fragments are formed;

a discharging screw that discharges the reduced iron agglomerates and the seized hearth fragments from the reduction furnace; and a sieve positioned to receive the reduced iron agglomerates and the seized hearth fragments discharged by the discharging screw, wherein the sieve separates the reduced iron agglomerates from at least a portion of the seized hearth fragments.

14. The apparatus according to claim 13, wherein the sieve is a roller screen.

* * * * *

UNITED STATES PATENT AND TRADEMARK OFFICE

CERTIFICATE OF CORRECTION

PATENT NO. : 6,319,302 B1
DATED : November 20, 2001
INVENTOR(S) : Harada

It is certified that error appears in the above-identified patent and that said Letters Patent is hereby corrected as shown below:

Title page, Item [54], and Column 1, lines 1-3,
The Title should read:
-- [54] METHOD FOR MANUFACTURING REDUCED IRON AGGLOMERATES AND APPARATUS THEREFOR --
Item [73], the Assignee's information should read:
-- [73] Assignee: Kabushiki Kaisha Kobe Seiko Sho (Kobe Steel, Ltd.), Kobe-shi (JP) --

Signed and Sealed this

Twenty-first Day of May, 2002

*Attest:*

*Attesting Officer*

JAMES E. ROGAN
*Director of the United States Patent and Trademark Office*